US009896905B2

(12) United States Patent
Noui-Mehidi

(10) Patent No.: US 9,896,905 B2
(45) Date of Patent: Feb. 20, 2018

(54) INFLOW CONTROL SYSTEM FOR USE IN A WELLBORE

(71) Applicant: Saudi Arabian Oil Company, Dhahran (SA)

(72) Inventor: Mohamed Nabil Noui-Mehidi, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 395 days.

(21) Appl. No.: 14/511,637

(22) Filed: Oct. 10, 2014

(65) Prior Publication Data

US 2016/0102524 A1 Apr. 14, 2016

(51) Int. Cl.

| | |
|---|---|
| ***E21B 43/08*** | (2006.01) |
| ***E21B 34/08*** | (2006.01) |
| ***E21B 33/124*** | (2006.01) |
| ***E21B 43/12*** | (2006.01) |
| ***E21B 43/14*** | (2006.01) |
| ***E21B 43/16*** | (2006.01) |

(52) U.S. Cl.

CPC ..... *E21B 34/08* (2013.01); *E21B 33/124* (2013.01); *E21B 43/086* (2013.01); *E21B 43/12* (2013.01); *E21B 43/14* (2013.01); *E21B 43/16* (2013.01)

(58) Field of Classification Search

CPC ..... E21B 43/12; E21B 43/14; E21B 43/086; E21B 43/16; E21B 33/124; E21B 2034/007

See application file for complete search history.

(56) References Cited

U.S. PATENT DOCUMENTS 4,310,058 A * 1/1982 Bourgoyne, Jr. ..... E21B 21/00 175/207
4,478,279 A * 10/1984 Puntar ..... E21B 21/10 166/121

(Continued)

FOREIGN PATENT DOCUMENTS

WO 2011/050094 A2 4/2011
WO WO 2011/050094 A2 4/2011

(Continued)

OTHER PUBLICATIONS

PCT Search Report dated Jan. 22, 2016—S.N. PCT/US2015/054757, Filed Oct. 8, 2015.

(Continued)

*Primary Examiner* — Robert E Fuller
*Assistant Examiner* — David Carroll
(74) *Attorney, Agent, or Firm* — Bracewell LLP; Constance G. Rhebergen; Keith R. Derrington

(57) ABSTRACT

A well system for producing fluids from a well that intersects a subterranean formation; where the well system includes an inflow control device for providing a continuous rate of fluid flow. The inflow control device is formed so that the pressure drop of the fluid per unit length remains substantially constant along the length of the well. The inflow control device has an inner diameter that increases at a constant rate with distance from the bottom of the well. Multiple inflow control devices are coupled together in series to form an inflow control system in the well, and wherein the inner diameter of the inflow control system uniformly increases with distance from the bottom of the well.

16 Claims, 1 Drawing Sheet

(56) References Cited

U.S. PATENT DOCUMENTS

| | | | | |
|---|---|---|---|---|
| 5,848,643 | A * | 12/1998 | Carbaugh | E21B 33/085 166/84.3 |
| 6,167,966 | B1 | 1/2001 | Ayasse et al. | |
| 6,533,038 | B2 | 3/2003 | Venning et al. | |
| 6,581,702 | B2 * | 6/2003 | Dickey | E21B 10/18 175/339 |
| 6,854,534 | B2 * | 2/2005 | Livingstone | E21B 17/203 175/213 |
| 8,082,990 | B2 | 12/2011 | Lovell et al. | |
| 8,631,877 | B2 | 1/2014 | Gewily | |
| 8,662,178 | B2 | 3/2014 | Norrid et al. | |
| 8,689,892 | B2 | 4/2014 | Noui-Mehidi | |
| 2004/0104030 | A1 * | 6/2004 | Livingstone | E21B 21/08 166/312 |
| 2007/0084603 | A1 * | 4/2007 | Livingstone | E21B 17/18 166/285 |
| 2008/0000255 | A1 * | 1/2008 | Wilson | F25B 41/067 62/324.6 |
| 2009/0050313 | A1 | 2/2009 | Augustine | |
| 2012/0111574 | A1 | 5/2012 | Desranleau et al. | |
| 2013/0220641 | A1 | 8/2013 | Fripp et al. | |
| 2013/0269949 | A1 | 10/2013 | Young | |
| 2014/0096963 | A1 | 4/2014 | Sharma et al. | |
| 2015/0144335 | A1 * | 5/2015 | Eriksen | E21B 10/66 166/250.01 |

FOREIGN PATENT DOCUMENTS

| | | | |
|---|---|---|---|
| WO | WO 2011/050094 A3 | 4/2011 | |
| WO | WO 2011050094 A2 * | 4/2011 | E21B 43/24 |

OTHER PUBLICATIONS

PCT International Search Report and The Written Opinion of the International Searching Authority dated Jan. 22, 2016; International Application No. PCT/US2015/054757; International Filing Date: Oct. 8, 2015.

* cited by examiner

INFLOW CONTROL SYSTEM FOR USE IN A WELLBORE

BACKGROUND OF THE INVENTION

1. Field of Invention

The present disclosure relates in general to a system for draining a wellbore with an inflow control system that has a diameter that increases substantially continuously with distance away from a lower end of the wellbore.

2. Description of Prior Art

Wellbores for the production of hydrocarbon are typically lined with casing, which is then perforated adjacent a producing or formation zone. Fluid produced from the zone is typically directed to surface within production tubing that is inserted within the casing. Formation fluids generally contain stratified layers of gas, liquid hydrocarbon, and water. Boundaries between these three layers are often not highly coherent, thereby introducing difficulty for producing a designated one of the fluids. Also, the formation may have irregular properties or defaults that cause production to vary along the length of the casing. It is usually desired that the fluid flow rate remain generally consistent along the length of the casing.

A fluid flow rate from one formation that varies within the casing may inadvertently cause production from another of the formation zones. This is especially undesirable when water is present in the other formation zone, which can lead to a water breakthrough into the primary flow. To overcome this problem and to control frictional losses in wells, an inflow control device ("ICD") is sometimes provided in the wellbore. The ICD is useful for controlling fluid flow into the wellbore and for controlling pressure drop along the wellbore. Multiple fluid flow devices may be installed, each controlling fluid flows along a section of the wellbore. These fluid control devices may be separated from each other by conventional packers. Other benefits of using fluid control devices include increasing recoverable reserves, minimizing risks of bypassing reserves, and increasing completion longevity.

SUMMARY OF THE INVENTION

Disclosed herein is an example of a well system for use in a wellbore, and which includes an elongated tapered body, an inlet on an end of the body proximate to a lower end of the wellbore, an outlet on an end of the body distal from the inlet, openings formed radially through a sidewall of the tapered body, and an inner diameter of the body that widens a uniform amount per linear distance from the inlet to the outlet. The body can have a series of annular inflow control devices joined in series, wherein each of the inflow control devices can be an annular member having an inlet, an outlet with a diameter greater than a diameter of the inlet, and wherein an inner diameter of each inflow control device increases linearly between their respect inlets and outlets. In one example, when fluid flows through the tapered body, the enlarging of the inner diameter provides a constant pressure drop of the fluid flow per unit length. The openings can be substantially elongated, or may have an outer periphery that is substantially curved. Packers may optionally be disposed between the body and an inner surface of the wellbore. In one embodiment, the body is disposed in a substantially horizontal portion of the wellbore. Alternatively, the body is adjacent more than one fluid producing zone intersected by the wellbore.

Also disclosed is a well system for use in a wellbore and which is made up of an elongate tapered member disposed in a horizontal portion of the wellbore and having an inner diameter that increases linearly with distance away from a bottom end of the wellbore, an inlet on an end of the tapered member that is proximate the bottom end of the wellbore, and an outlet on an end of the tapered member distal from the inlet and that has a diameter greater than a diameter of the inlet. In one example, the tapered member is made of annular inflow control devices joined together in series. An outlet of each inflow control device can insert into an inlet of an adjacent downstream inflow control device to define a junction, wherein the junction has a diameter than uniformly changes with axial unit distance within the tapered member. The well system can further include openings formed radially, or tangentially, through a sidewall of the tapered member.

Another example of a well system for use in a wellbore includes a series of tapered. inflow control devices joined in series to form an elongated tapered member, an inlet end on the tapered member proximate a bottom of the wellbore, an exit end on the tapered member distal from the inlet end, joints defined where each of the inflow control devices are joined, and an inner diameter of the tapered member that increases linearly from the inlet end to the exit end and along each of the joints, so that when fluid flows through the tapered member, a constant pressure drop is attained in the fluid flow. The well system can further include packers that circumscribe the tapered member and extend radially outward into sealing contact with the wellbore. Openings may optionally be provided in a sidewall of the inflow control devices that provide a fluid flow path from the wellbore and into the tapered member. In one example, the tapered member is in a horizontal portion of the wellbore. In an alternate embodiment, the tapered member is adjacent more than one subterranean zone that produces wellbore fluid.

BRIEF DESCRIPTION OF DRAWINGS

Some of the features and benefits of the present invention having been stated, others will become apparent as the description proceeds when taken in conjunction with the accompanying drawings, in which.

Figures 1, 2:
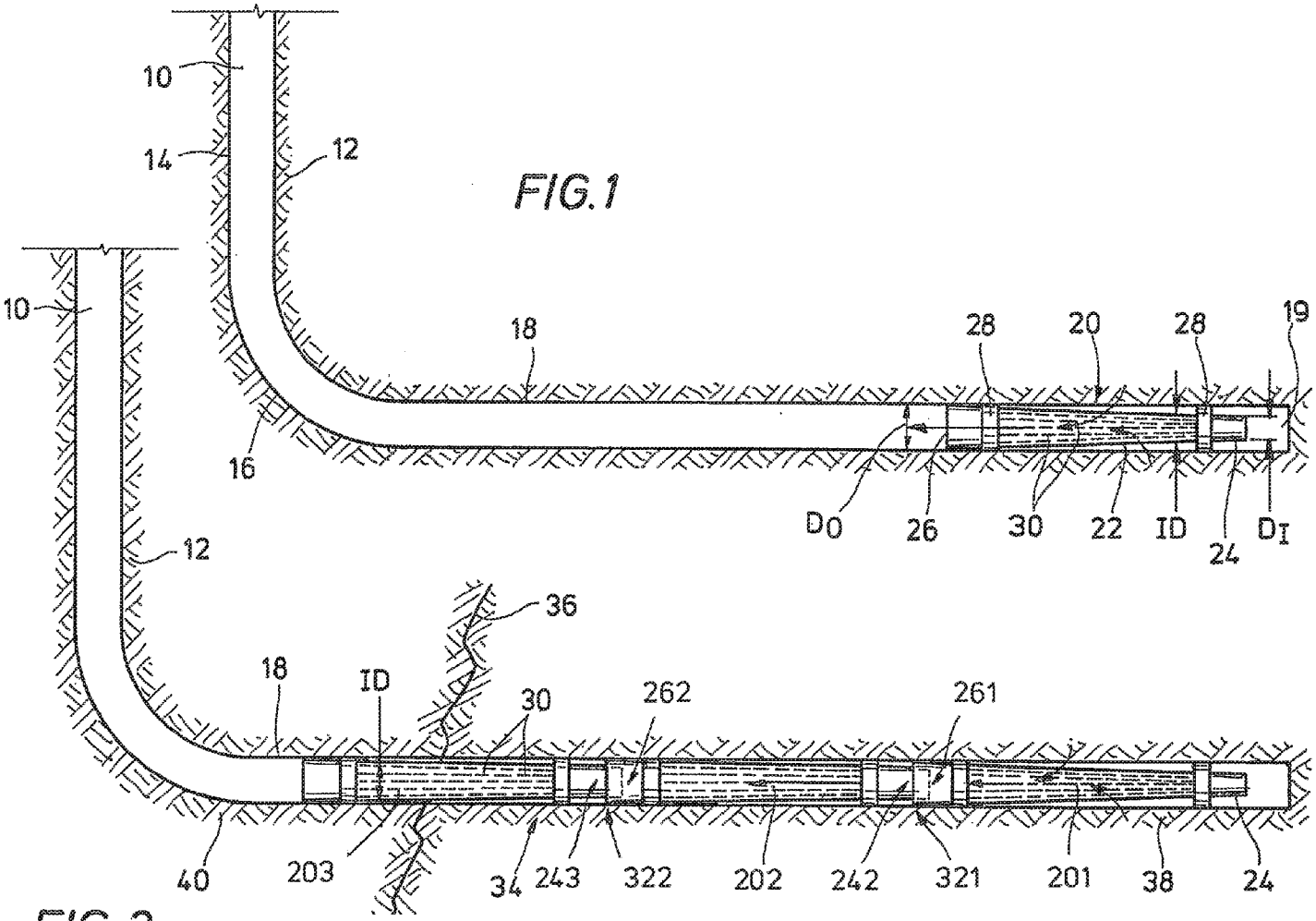
FIG. 1 is a partial sectional view of an example of an inflow control device disposed within a wellbore.
FIG. 2 is a partial sectional view of a string of inflow control devices within a wellbore that define an inflow control system.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/− 5% of the cited magnitude. In an embodiment, usage of the term "substantially" includes +/− 5% of the cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and although specific terms are employed, they are used in a generic and descriptive sense only and not for the purpose of limitation FIG. 1 shows in a side sectional view an example of a wellbore 10 formed through a subterranean formation 12. The wellbore 10 includes a vertical portion 14 and a bend 16 where the vertical portion 14 transitions into a horizontal portion 18. Shown disposed adjacent a lower end 19 of the wellbore 10 is an example of an inflow control device ("ICD") 20 for controlling fluid flow within the wellbore 10. The ICD 20 is made up of an annular body 22 with an internal diameter ID that increases (or tapers) from its inlet 24 to its exit 26. More specifically, in the illustrated example the internal diameter ID increases linearly so that the increase of the internal diameter ID is constant along the axial length of the ICD 20. Also illustrated in FIG. 1 is that the diameter $D_I$ at the inlet 24 is less than the diameter $D_O$ at the exit 26. Optionally, packers 28 can be included in the wellbore 10 and that circumscribe the ICD 20 at spaced apart axial locations from one another. Openings 30 are schematically depicted formed radially through a sidewall of the ICD 20 and for allowing flow from the formation 12 to enter into the ICD 20 and be directed to surface. Alternatively, openings 30 can be formed tangentially through sidewall of the ICD 20.

FIG. 2 shows multiple ICDs 201, 202, 203 joined together in series. Joints 321, 322 are formed respectively where ICDs 201, 202 are joined and where ICDs 202, 203, are joined. The ICDs 201, 202, 203 joined together as shown define an inflow control system 34. The respective outer diameters of the outlets 261, 262 are strategically sized to match inner diameters of the inlets 242, 243 so that the inner diameter ID of the inflow control system 34, like the individual ICDs 201, 202, 203 increases linearly along the axial length of the inflow control system 34. An advantage of maintaining the ID of the inflow control system 34 to be linearly increasing is that when fluid is flowing through the inflow control system 34, a pressure drop of the fluid can remain substantially constant per unit length. As described above, maintaining a constant per unit pressure drop can maintain a pressure of the flowing fluid above a threshold value and thereby prevent inflow of fluid from other formations. Maintaining fluid pressure can also avoid or delay water breakthrough into the flow of fluid in the inflow control system 34.

Further shown in FIG. 2 is that the formation 12 includes a boundary 36 that intersects the horizontal portion 18 of the wellbore 10. The boundary 36 defines a border between adjacent zones 38, 40. In one example, conditions in zone 38 are different from conditions in zone 40. For example, zone 38 can have a different pressure than zone 40, or can contain/produce a different fluid than zone 40. Implementation of the inflow control system 34 can maintain a sufficient pressure when producing fluid from zone 38, such that fluid from zone 40 is prevented from penetrating through the openings 30 formed in the sidewall of the inflow control system 34. As such, should water be present in zone 40, the water can be kept out of the fluid being produced from zone 38 in the inflow control system 34.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. For example, the openings 30 can be slits, elongated slots, have a curved outer periphery, or be combinations thereof. These and other similar modifications will readily suggest themselves to those skilled in the art, and are intended to be encompassed within the spirit of the present invention disclosed herein and the scope of the appended claims.

What is claimed is:

1. A well system for use in a wellbore comprising:
- an elongated tapered body;
- an inlet on an end of the body proximate to a lower end of the wellbore;
- an outlet on an end of the body distal from the inlet;
- openings formed through a sidewall of the tapered body;
- packers disposed between the body and an inner surface of the wellbore; and
- an inner diameter of the body that widens a uniform amount per linear distance from the inlet to the outlet.

2. The well system of claim 1, wherein fluid is received by the openings combines with fluid that enters the body through the inlet to form a combined fluid, and wherein when combined fluid flows through the tapered body, the enlarging of the inner diameter provides a constant pressure drop of the combined fluid flow per unit length.

3. The well system of claim 1, wherein the openings are substantially elongated.

4. The well system of claim 1, wherein the openings have an outer periphery that is substantially curved.

5. The well system of claim 1, wherein the body is disposed in a substantially horizontal portion of the wellbore.

6. The well system of claim 1, wherein the body is adjacent more than one fluid producing zone intersected by the wellbore.

7. A well system for use in a wellbore comprising:
- an elongate tapered member selectively mounted in and coupled to a horizontal portion of the wellbore and having an inner diameter that increases linearly with distance away from a bottom end of the wellbore;
- openings formed through a sidewall of the tapered member;
- packers between the tapered member and sidewalls of the wellbore;
- an inlet on an end of the tapered member that is proximate the bottom end of the wellbore and that is in communication with fluid produced from a formation adjacent the wellbore; and
- an outlet on an end of the tapered member distal from the inlet and that has a diameter greater than a diameter of the inlet.

8. The well system of claim 7, wherein the tapered member comprises a first annular inflow control device, the well system further comprises additional inflow control devices, wherein the first annular inflow control device and the additional annular inflow control devices are joined together in series.

9. The well system of claim 8, wherein an outlet of each inflow control device inserts into an inlet of an adjacent downstream inflow control device to define a junction, wherein the junction has a diameter than uniformly changes with axial unit distance within the annular member.

10. The well system of claim 7, wherein the openings are radially formed through the sidewall of the tapered member.

11. The well system of claim 7, wherein the openings are tangentially formed through the sidewall of the tapered member.

12. A well system for use in a wellbore comprising:

a series of tapered inflow control devices joined in series to form an elongated tapered member;

an inlet end on the tapered member proximate a bottom of the wellbore;

an exit end on the tapered member distal from the inlet end;

joints defined where each of the inflow control devices are joined; and an inner diameter of the tapered member that increases linearly from the inlet end to the exit end and along each of the joints, so that when fluid flows through the tapered member, a constant pressure drop is attained in the fluid flow.

13. The well system of claim 12, further comprising packers that circumscribe the tapered member and extend radially outward into sealing contact with the wellbore.

14. The well system of claim 12, further comprising openings in a sidewall of the inflow control devices that provide a fluid flow path from the wellbore and into the tapered member.

15. The well system of claim 12, wherein the tapered member is in a horizontal portion of the wellbore.

16. The well system of claim 12, wherein the tapered member is adjacent more than one subterranean zone that produces wellbore fluid.

* * * * *